US009833077B2

(12) United States Patent
Arens et al.

(10) Patent No.: US 9,833,077 B2
(45) Date of Patent: Dec. 5, 2017

(54) HEATED AND COOLED CHAIR APPARATUS

(71) Applicant: THE REGENTS OF THE UNIVERSITY OF CALIFORNIA, Oakland, CA (US)

(72) Inventors: Edward A. Arens, Berkeley, CA (US); Hui Zhang, Moraga, CA (US); Wilmer Pasut, Albany, CA (US); Michael P. Andersen, Berkeley, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 228 days.

(21) Appl. No.: 14/816,234

(22) Filed: Aug. 3, 2015

(65) Prior Publication Data

US 2016/0029805 A1 Feb. 4, 2016

Related U.S. Application Data

(63) Continuation of application No. PCT/US2014/014671, filed on Feb. 4, 2014.
(Continued)

(51) Int. Cl.
*A47C 7/74* (2006.01)

(52) U.S. Cl.
CPC ..... *A47C 7/744* (2013.01); *A47C 7/748* (2013.01)

(58) Field of Classification Search
CPC ..... A47C 7/744; A47C 7/748
(Continued)

(56) References Cited

U.S. PATENT DOCUMENTS 3,902,753 A 9/1975 Wilson
5,597,200 A 1/1997 Gregory et al.
(Continued)

FOREIGN PATENT DOCUMENTS

EP 1129647 A1 9/2001
EP 0 730 422 B1 10/2001
WO 2014/121273 A2 8/2014

OTHER PUBLICATIONS

Hoyt, T. et al. Aug. 2-7, 2009, "Energy savings from extended air temperature setpoints and reductions in room air mixing," International conference on Environmental Ergonomics, Boston, 7 pages.
(Continued)

*Primary Examiner* — Anthony D Barfield
(74) *Attorney, Agent, or Firm* — O'Banion & Ritchey LLP; John P. O'Banion

(57) ABSTRACT

Articles of furniture with a system of heating and cooling that can be integrated into a building environmental control network are provided. The heating/cooling system of the article has surfaces of a porous or non-porous, moisture-permeable material allowing convective and evaporative heat exchange from the body surface to the environment. The material covers a plenum that has reflective surfaces to reduce radiant losses and low-wattage fans to circulate air that convectively cools the occupant. Resistance heating may be incorporated at key occupant contact areas in the seat and backrest. Temperature, occupancy and other sensors can be incorporated. A control interface controls the actions of the heating/cooling system of the article and can interact with a network server to transmit measurements of environmental temperatures and occupant selection of control settings that are useful for control of the building's indoor environment.

9 Claims, 4 Drawing Sheets

Related U.S. Application Data

(60) Provisional application No. 61/760,545, filed on Feb. 4, 2013.

(58) Field of Classification Search
USPC ..... 297/180.12, 180.14
See application file for complete search history.

(56) References Cited

U.S. PATENT DOCUMENTS

| | | | | |
|---|---|---|---|---|
| 5,624,312 | A * | 4/1997 | Collier | A47C 7/72 454/186 |
| 7,134,715 | B1 | 11/2006 | Fristedt et al. | |
| 8,505,320 | B2 | 8/2013 | Lofy et al. | |
| 8,516,842 | B2 | 8/2013 | Petrovski et al. | |
| 9,707,821 | B2 * | 7/2017 | Hill | B60H 1/00028 |
| 2003/0011222 | A1 | 1/2003 | Ichigaya | |
| 2005/0269859 | A1 | 12/2005 | Eriksson et al. | |
| 2007/0061847 | A1 * | 3/2007 | Callahan | B64D 11/0015 725/76 |
| 2009/0126110 | A1 | 5/2009 | Feher | |
| 2010/0146700 | A1 | 6/2010 | Wolas | |
| 2013/0328359 | A1 | 12/2013 | Antonov et al. | |

OTHER PUBLICATIONS

Zhang, H. et al. 2010. "Comfort, perceived air quality, and work performance in a low-power task-ambient conditioning system," Building and Environment 45(1), 29-3.

Pasut, W. et al., "Effect of a heated and cooled office chair on thermal comfort." The second International conference on Building Energy and Environment. Boulder, Colorado. Aug. 1-4, 2012, 19 pages.

Korean Intellectual Property Office, International Search Report and Written Opinion, dated Nov. 28, 2014, for corresponding International Patent Application No. PCT US2014/014671 (pp. 1-20) and claims (pp. 21-26) pp. 1-26.

* cited by examiner

HEATED AND COOLED CHAIR APPARATUS

CROSS-REFERENCE TO RELATED APPLICATIONS

This application is a 35 U.S.C. §111(a) continuation of PCT international application number PCT/US2014/014671 filed on Feb. 4, 2014, incorporated herein by reference in its entirety, which claims priority to, and the benefit of, U.S. provisional patent application Ser. No. 61/760,545 filed on Feb. 4, 2013, incorporated herein by reference in its entirety. Priority is claimed to each of the foregoing applications.

The above-referenced PCT international application was published as PCT International Publication No. WO 2014/121273 on Aug. 7, 2014 and republished on Jan. 15, 2015, which publications are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED IN A COMPUTER PROGRAM APPENDIX

Not Applicable

BACKGROUND OF THE INVENTION

1. Field of the Invention

This invention pertains generally to seating assemblies and more particularly to chairs with devices for occupant temperature control and thermal comfort.

2. Description of Related Art

Thermal comfort of individuals in living or working spaces is typically provided by modifying the temperature of the ambient air and the temperature of the surrounding surfaces in the indoor environment. Heating and cooling systems in a building produce temperature and humidity modified air that is normally distributed to the interior environment through fans and ductwork or through heated or cooled water pumped through radiators in the occupied environment. The comfort of an occupant depends on the rate at which the person exchanges heat with this environment.

The overall heating or cooling of people indoors may occur through four pathways: 1) convective sensible (or 'dry') heat transfer between the body surfaces and the surrounding temperature modified air, 2) evaporative heat loss from the skin surface through the clothing and furnishings to the surrounding temperature modified air, 3) radiation exchange with surrounding room and furnishing surfaces, and 4) by conduction to solid surfaces with which the body of the person is in contact. The overall thermal comfort of a person seated in a chair may be determined by one or more of these heat transfer pathways.

However, the rate and efficiency of heat transfers to or from a body and a chair can be negatively influenced by a number of factors. First, because part of the body is in contact with the chair, the body area that is exposed for convection to the temperature modified air is reduced. Second, the evaporation rate of body perspiration may be reduced by vapor resistance imparted by the surface, padding, and structure of the chair, resulting in diminished heat transfer from the body. Third, the chair may block the radiant emissions from the surrounding room surfaces. The chair also may exchange radiation with the person sitting in it, substituting the chair's temperature and radiant emission properties for those of the surrounding room surfaces. Fourth, the chair's conductive properties and thermal capacitance affect the rate of heat transfer out of the seated person when the chair is colder than the clothing temperature, or into the person when the chair is hotter than the clothing temperature. Conductive heat exchange is a prominent effect in vehicular environments which may be much colder or warmer than the person when the person enters the vehicle.

Thermal comfort levels can vary from person to person, typically across a range of about 6 degrees Fahrenheit (3 Kelvin). Consequently, the thermal requirements of some occupants may not be satisfied simply by ambient air temperature control. While the environment may be comfortable to some people, the temperature of the conditioned air or of the environment may be too cold or too hot for other people.

In addition, it may be necessary for the ambient air to be heated or cooled to warmer or colder temperatures than are comfortable in order to accelerate the rate of change of the overall temperature of the environment or of the temperature of the seat. In this setting, the conditioned air is often significantly colder or hotter than the preferred range of comfortable temperatures of an occupant for a period of time, especially at the beginning of the air conditioning cycle. For example, the temperature of a seat in a vehicle or in an enclosed room that has been exposed to the sun for a prolonged period of time can become very hot and may remain hot for a period of time even with exposure to air-conditioned air. It may require the introduction of air that is well below the comfort level of the occupant to the interior of the vehicle to accelerate the rate of cooling of the seat and the environment that air may be uncomfortable for the occupant for a period of time. Likewise, a vehicle seat that has been exposed to winter weather may be very cold and uncomfortable for the occupant requiring the introduction of hot air that greatly exceeds the comfort level of the occupant in order for the rate of temperature change in the seat and interior to be accelerated.

Even with the introduction of extremely conditioned air, the seat temperatures and the perceived interior temperatures may be slow to change because large portions of the body of the occupant of the seat isolate the seat and the body from the heat transfer effects of the conditioned air. Accordingly, the thermal comfort of stationary, seated occupants may not be provided comfortably or efficiently with the introduction of temperature controlled air into the environment.

Therefore, there are situations where a more individualized approach for providing occupant comfort is desirable over simply cooling or heating with temperature modified air. For example, a seat can heat or cool a person with less energy than is possible by heating or cooling the entire ambient space.

To this end, several different types of seats with individualized temperature control systems have been developed. These seats with temperature control systems are typically designed with a perforated seat or seat covering and a source of temperature conditioned air that is passed under pressure through the openings in the surface of the seat to the body of the occupant. Air used in such 'ventilated seats' can be ambient air, cooled air or heated air and the airflow across the mesh seat can be in either direction.

One problem experienced by ventilated seat systems is that prolonged exposure to the forced cooled supply air on the body can overcool back muscles and cause back spasms. The contact area of the occupant can also decrease the total flow of air through the seat perforations and diminish the effectiveness of the convection mechanism for heating or cooling the occupant.

Another problem with systems that force air through perforations in the seat surfaces is the need for a relatively high pressure source of temperature modified air, through fans and distribution system that can accommodate the pressure drop across the perforated surface and provide a sufficient air flow.

A further problem with the conventional ventilated seats is the noise that is created by the fans that are part of a pressurized air distribution system that is audible through the surface of the seat. The noise created by the fans, air ducts and air conditioning devices increases with the desired airflow and size of the system to overcome the big pressure drop through the perforated seat surface.

Accordingly, there exists a need for seating with an individualized temperature control system that is efficient, has a low noise level and is effective in heating or cooling the user. The present invention satisfies these needs as well as others and is an improvement in the art.

BRIEF SUMMARY OF THE INVENTION

The present invention is an article of furniture, such as a chair with a seat, back support and a base or legs, which has a system for heating or cooling the occupant. Each chair can be part of an integrated environmental control network that includes air heating and cooling control as well as seat temperature control. The seat is capable of individual environmental control that may be coordinated with air temperature control that can satisfy the temperature requirements of multiple occupants whose interpersonal temperature requirements naturally differ.

An office chair embodiment is used to illustrate the invention. The typical chair has a generally horizontal seat supported by a base and a generally vertical backrest. Although an office chair is used as an illustration, the invention can be adapted to any article of furniture that is designed to allow an occupant to sit or recline.

The surface of the seat and backrest of the chair are preferably covered with a lightweight, moisture-permeable material that may be either porous or non-porous to air. The moisture permeable covering transmits moisture and controls the rate of sweat evaporation and removal from the occupant.

The seat and back rest preferably include an enclosed or partially-enclosed plenum behind the seating surface and at least one fan that circulates air in the interior of the plenum. A similar plenum and fan may be present in the structure of the backrest. In one embodiment, the backplane surfaces of the plenum in the seat and backrest interiors may be absorptive or reflective to radiation in the infrared range. In another embodiment, the plenum interior may also be thermally insulated to reduce heat transfer to and from the environment and to reduce any possible noise generated by the low-wattage fans producing air circulation.

Convection in the chair plenums cools the occupant sensibly through evaporation. The reflective backplane of the plenum protects the occupant against radiation gain from very hot surfaces found in vehicles during summer months especially on first entry. It also protects the occupant against radiative heat loss to cold surfaces in either a car or a building during winter months. The plenum, with its seating surface suspended in front of it, act to keep the thermal capacitance in contact with the occupant's skin as low as possible. The reflective backplane surfaces of the plenum may also be angled to maximize reflectance. All of these plenum features combine to reduce unwanted transient and steady-state heat transfer between the occupant and chair, and to maximize the comfort effectiveness and energy-efficiency of the chair's cooling and heating elements.

In one embodiment, resistance heating elements may be sewn, cemented, or woven into the seating surface fabric in key body contact areas in the seat and backrest. The localized heating of the skin by resistive elements exploits the concept of sensory alliesthesia operating spatially across the skin surface.

The efficiency of the chair heating system may be improved by exploiting the reflective surfaces in the plenum that reduces radiant heat loss from the body to the environment as well as redirecting radiant heat from the resistance heating elements that would otherwise escape to the environment. For example, the reflective plenum surfaces can improve both heating and cooling effectiveness in automobile seats, since the compartments of automobiles can be much colder or hotter than the occupant's clothing temperature, especially when an occupant first enters the hot or cold car. In addition, the resistive element is the most power-intensive component of the chair so maximizing its efficiency is more important than the slight reduction in cooling effect caused by the reflective plenum surfaces.

The fans increase the heat loss from the occupant's body through the seating surface of the chair primarily by increasing convective heat and moisture exchange across the underside and backside surfaces of the surface fabric or mesh. This is in contrast with ventilation approaches that primarily work by pushing or pulling air through perforations in the surface of the seat.

The convective cooling through the seating or backrest material surfaces exploits the observation that the air movement produced by the fans is not detectable by the body even through the most open fabrics, such as mesh, but the cooling is detectable in all fabrics, porous and non-porous. This produces a superior comfort effect without producing localized and varying cold spots on the skin. The convective cooling through the mesh surface also exploits the observation that convective and evaporative heat exchange produces superior comfort to that of solid cooled surfaces, which inhibit evaporative exchange from the body surface to the environment.

The chair may operate on battery power, preferably configured to operate for multiple days between re-chargings. The chair may contain batteries, a charging circuit, and a charger. The charger can be located either internal to the chair or kept separately at a workstation.

In another embodiment, the chair has an occupancy sensor that switches off power during periods when the chair is unoccupied. There may also be a delay circuit to reduce the amount of short-term cycling of the heating/cooling power. Other sensors such as temperature, infrared and humidity sensors may also be included in the chair to monitor the ambient thermal environment surrounding the chair and its occupant.

Control over the fans, heating elements, battery monitoring and charging levels is provided with a controller. In one embodiment, the chair has controls for system activation, fan on/off, selection of heating or cooling mode, sensor monitoring and the intensity of heating or cooling.

A digital controller with a touch screen interface is preferred. The controller can also be wireless with a portable interface screen such as a mobile telephone application.

Sensor monitoring, setting adjustments, time, cycle programming, network communications, temperature threshold levels and other control functions can be performed by the digital controller.

In another embodiment, the controller is a set of analog switches and variable resistors that are configured to turn on and off, and adjust the power to the fans and the heating elements.

The controller can also be integrated into a building environmental control system through wireless communication to a computer hub. In one embodiment, control of air conditioning or heating for a room or group of rooms is influenced by input provided by the chair controller or a network of controllers, indicating the ambient temperatures at the chair location, and the settings selected by the occupant or occupants of the chair or networked collection of chairs.

The chair may be equipped with an apparatus that measures and collects information about chair occupancy, air temperature, and the occupant's choice of control settings. This information can be sent through a cable or wireless interface to a server or other devices, and be used to control the operation of third-party devices such as the building's central air conditioning system.

According to one aspect of the invention, an article of furniture is provided that has a system for heating or cooling an occupant.

Another aspect of the invention is to provide a chair that has an airstream traversing across the underside of a moisture permeable material that does not require the airstream to flow through perforations in the fabric to cool the user.

A further aspect of the invention is to provide a chair that has a plenum backplane with reflective surfaces for directing heating and cooling to the user of the chair.

Another aspect of the invention is to provide an integrated network of chairs and environmental control systems to permit dynamic control over the local environment surrounding the chairs as well as the general environment.

Another aspect of the present invention is to provide a chair heating and cooling system that is relatively inexpensive and that can be easily adapted to a variety of chair or other seating or reclining furniture designs.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWINGS

The invention will be more fully understood by reference to the following drawings which are for illustrative purposes only.

DETAILED DESCRIPTION OF THE INVENTION

Referring more specifically to the drawings, for illustrative purposes an embodiment of a heated and cooled chair for energy efficient personal comfort of the present invention is depicted generally in FIG. 1 through FIG. 4. It will be appreciated that the system may vary as to the elements, specific steps and sequence and the apparatus structure may vary as to structural details, without departing from the basic concepts as disclosed herein.

Figure 1:
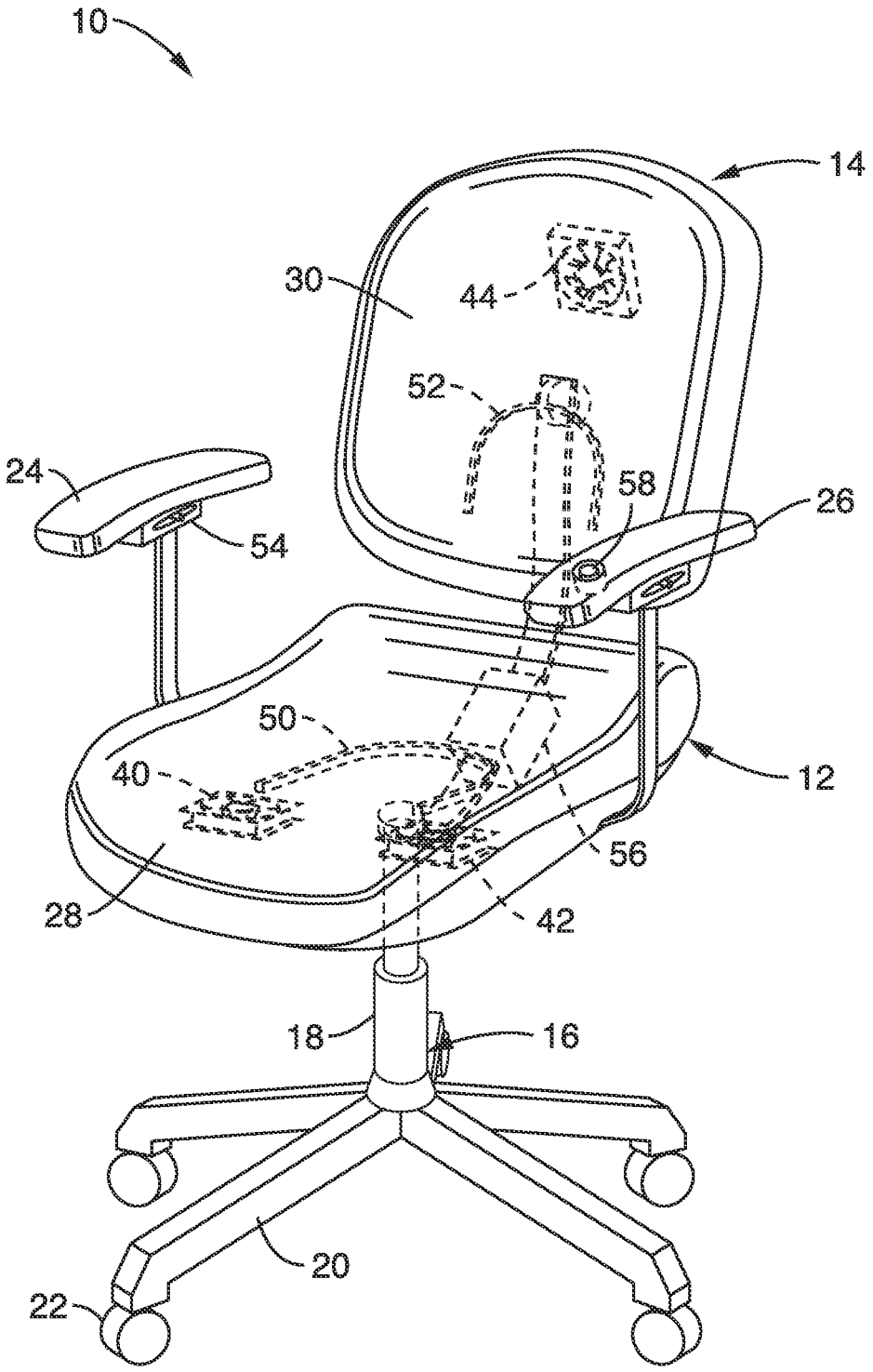
FIG. 1 is an isometric front view of one embodiment of a heated or cooled chair according to the invention.
Figure 2:
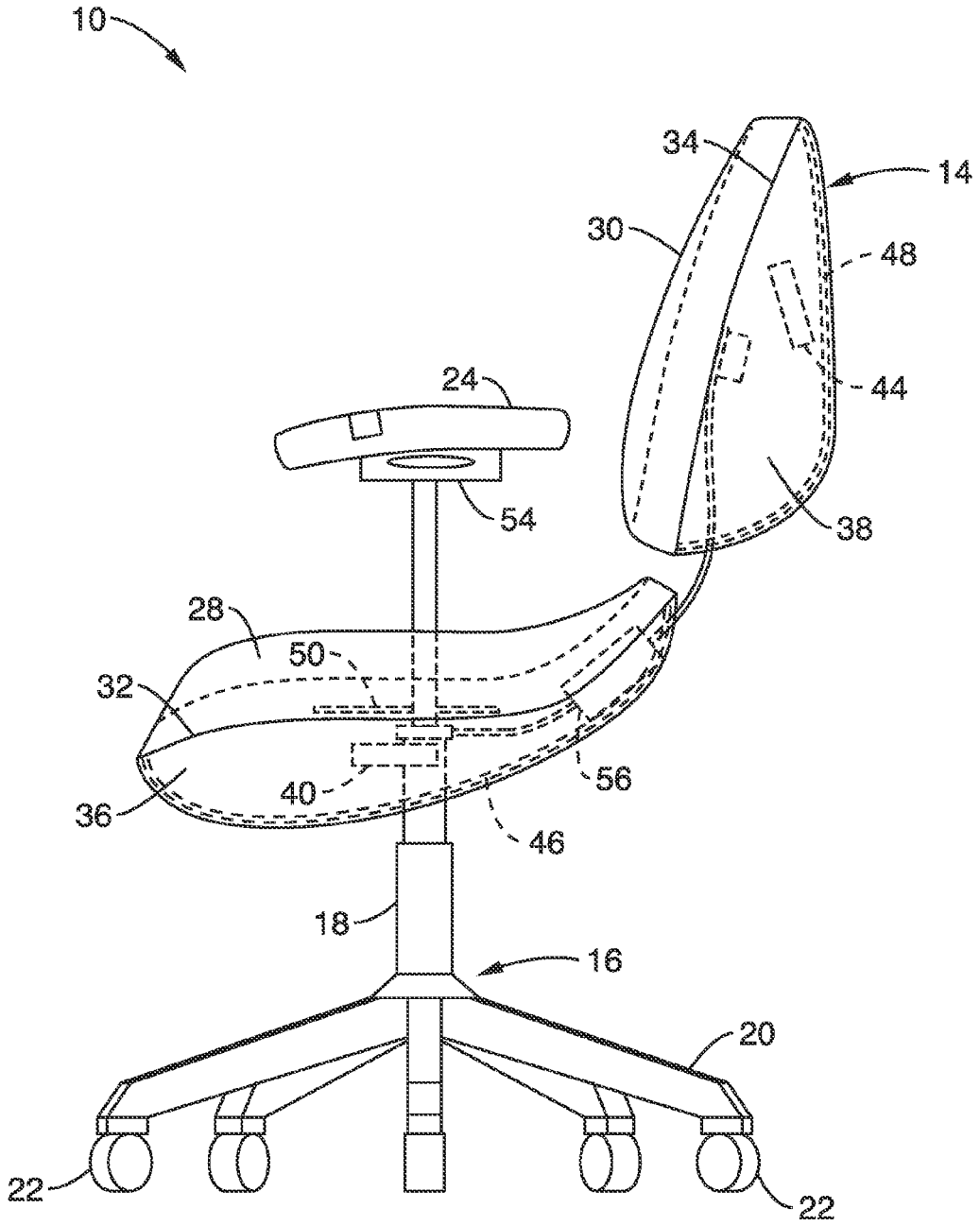
FIG. 2 is a schematic side view of the chair of FIG. 1.
Figure 3:
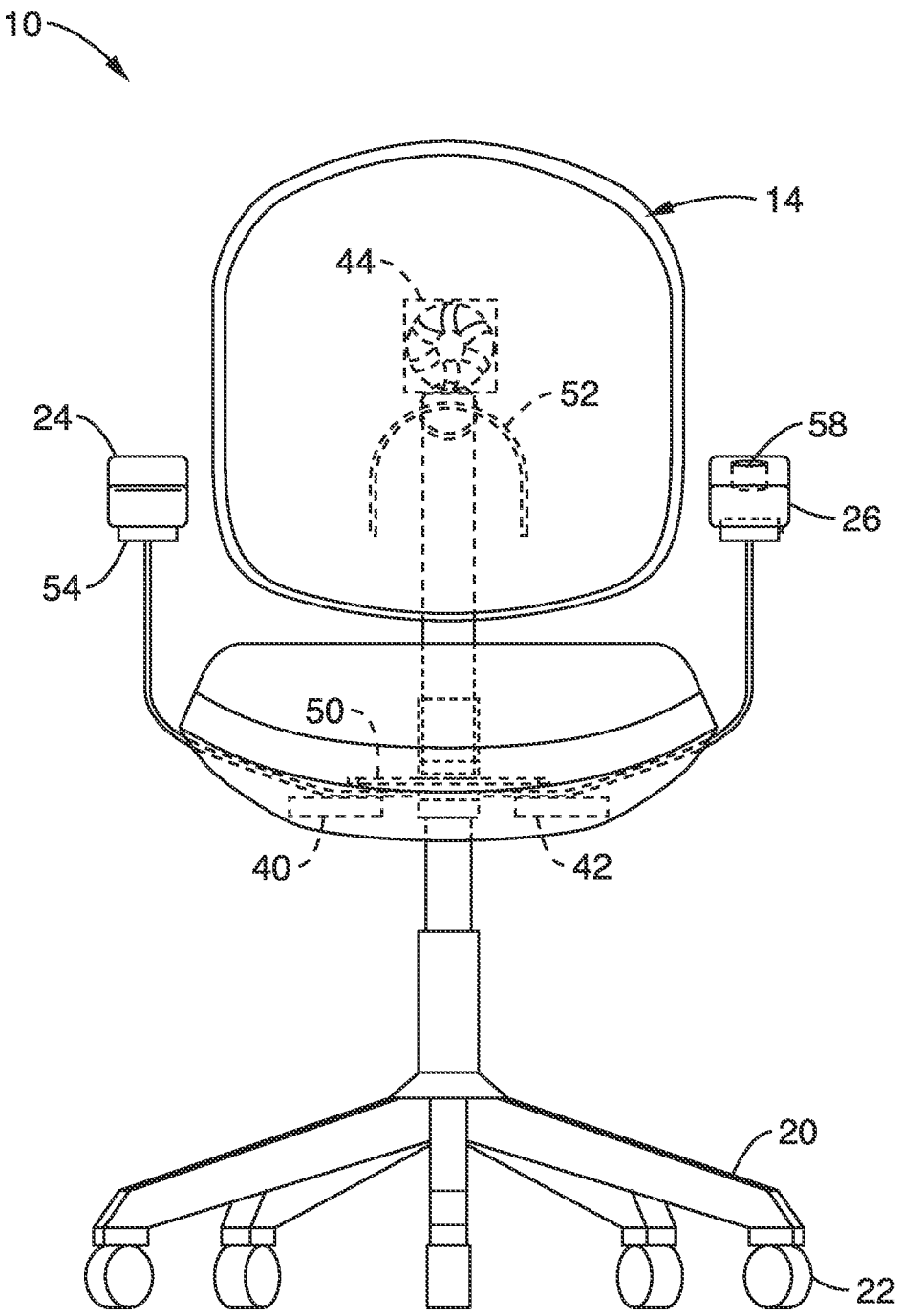
FIG. 3 is a front view of the chair of FIG. 1.

Turning now to FIG. 1 through FIG. 3, an embodiment of a chair 10 with an occupant heating and cooling system is schematically shown. The chair 10 used to illustrate the invention is a typical office desk chair with a generally horizontal seat 12 and a generally vertical back rest 14 that are mounted to a base 16. The seat 12 and the back rest 14 can be separate features as shown in FIG. 1 through FIG. 3 or the seat and the back rest can be joined together on one edge. Although a desk chair design is used to illustrate the invention, it will be understood that the heating and cooling system can be adapted to many different chairs, couches, vehicle seats or other articles of furniture that support the body of an occupant in a sitting or reclining position. Such furniture could include, for example, chairs used in homes, offices, places of business, auditoriums, schools, and vehicles.

In the office desk chair embodiment of FIG. 1 through FIG. 3, the base 16 has a central column 18 that is supported by five legs 20 and wheels 22 that allows the chair to be moved easily. The seat 12 can also rotate axially on the column 18.

Optionally, seat 12 can have a left arm rest 24 on one side and a right arm rest 26 on the opposite side of the seat. The arm rests 24, 26 can be vertically and horizontally adjustable and may provide support for sensors, control features, communication features or power components such as batteries.

The outer covering 28 of the structure of seat 12 and the outer covering 30 the back rest 14 are preferably composed of a moisture permeable, lightweight, fabric material. The seat and back rest coverings 28, 30 can be porous or non-porous to air and can be made from any moisture permeable material. The preferred moisture permeable material of the coverings 28, 30 of the chair 10 inherently have a very low thermal capacity compared to an insulated chair, and so the conductive heating and cooling sensations that are so important when people first sit down are minimized.

The outer coverings 28, 30 of the seat 12 and back rest 14 may be optionally supported by an internal framework such as ribs or by an outer frame for stretching a mesh or other seat surface material. The outer coverings may also be supported by an inner mesh support 32, 34 of metal or by fiber strands as seen in FIG. 2. However, the internal structure 32, 34 of the seat 12 or back rest 14 should allow the underside of the outer coverings 28, 30 to be open to the interior of the plenums in the seat and back rest structures.

As shown in the side view of the seat 12 and backrest 14 of FIG. 2, the back of the structure of seat 12 includes an enclosure forming a plenum 36. Likewise, a plenum 38 is formed in the back portion of the structure of the back rest 14. The volume of the plenum 36 or plenum 38 will vary depending on the dimensions of the seat 12 or backrest 14.

Integrated into the chair 10 are one or more fans. In this illustration, three 1.2 watt fans are used for an aggregate power consumption that preferably does not exceed 3.6 watts. These fans provide a source of air flow into the plenum portions of the chair. The seat section forming plenum 36 has two fans, a left side fan 40 and a right side fan 42. The backrest 14 has one fan 44 in the embodiment shown in FIG. 1 through FIG. 3.

An airstream is provided by the fans 40 and 42 in the plenum 36 of seat 12 that travels across the side of the moisture permeable fabric that is opposite to the side of the fabric engaging the body of a user. The airstream does not require flow through openings in the fabric to provide cooling to the user. The transmission of moisture through the cover 28 and away from the occupant can be evaporated or moved by the airstream in plenum 36 allowing control over rate of sweat evaporation and removal.

Similarly, fan 44 directs a stream of air across the interior surface of the outer covering of moisture permeable material 30 in the plenum 38 of the backrest 14. It should be noted that the airflow on the underside of the coverings 28, 30 very effectively cools the body positioned on the front of the material. Conventional perforated automotive ventilated seats push or pull air through holes in the seat surface and do not use an airstream across the backside of the seat fabric/leather to provide the main cooling of the occupant. This is an important feature of the present invention because the fan system has a much smaller pressure drop and thus can operate more efficiently and function more effectively. It has been observed that the body sitting in the chair 12 does not perceive any air movement, just cooling, because the air movement is on the other side of a porous or non-porous fabric from that contacting the skin. This makes the cooling effect of the invention very pleasurable compared to perforated seats.

The back wall forming the interior of plenum 36 of seat 12 preferably has an infrared reflective liner 46 and the plenum interior may also be insulated. A similar liner 48 of an infrared reflector and optional insulation is placed in the plenum 38 of the backrest 14. The plenum backplane liners 46, 48 with interior reflective surfaces are provided to: 1) focus and/or direct the sources of heating toward the user and to prevent thermal losses to the environment behind the chair; and 2) the reflective backplane also isolates unwanted heating from hot surroundings behind the chair especially in vehicles in the summer. The interior of each of the plenums 36, 38 is preferably unobstructed by supports or insulation as much as possible to maximize airflow and air circulation provided within the plenum by the fans, and to minimize the thermal capacity of those portions of the seat that thermally interact with the occupant.

Also depicted in FIG. 1 and FIG. 3 are a plurality of heating elements that are below or integrated into the material coverings 28, 30 of the seat 12 and backrest 14. These heating elements provide a source of heating through the covering material in the chair. In this embodiment, heating tapes 50 are disposed below or in the material of outer covering 28 or in the interior of plenum 36 of the seat 12. The heating element 50 can be activated to produce a range of temperatures. Likewise, heating tape 52 is disposed below or in the outer covering 30 of the backrest 14. The aggregate power consumption of the heating tapes 50, 52 preferably does not exceed 14 watts in one embodiment. Although the heating elements 50, 52 in this illustration are tapes, the heating elements can take several forms including resistive wires, cartridge heaters and even small reflector lamps focusing radiation from their filaments toward the skin.

A control 54 with an interface allows the activation of fans and heating elements and to adjust the amount of heating or cooling as well as the timing of activation events. In one embodiment, the control of the fan actuation and fan motor speeds and the actuation and power level to the heating elements is under analog control with the control 54 incorporating potentiometers and switches for voltage control. One preferred voltage control configuration that is power efficient is a buck converter configuration.

The control 54 may be located on the arm rest of the seat if the seat as shown in FIG. 1 through FIG. 3, is equipped with armrests. However, the control 54 can be located at many different locations such as on the left edge or right edge of the seat 12 to give the occupant easy access to the control and display functions of the seat. The control 54 may also be detachable and wireless in one embodiment.

In another embodiment, the control 54 is a digital control. The digital controller controls the power to the heating strips and the fans but does not incorporate a potentiometer in this embodiment. One digital controller uses pulse width modulation to control events rather than by voltage control. Another digital controller 54 embodiment also includes a programmable remote control device such as a tablet, smart phone or a dedicated device with an interface that can display and execute control functions, user preferences and chair status. In another embodiment, the chair has both a controller 54 on the chair and a remote control that allows the controller 54 to be controlled remotely by the remote control as well as controlled directly by the occupant.

Power is preferably provided to the chair components with rechargeable batteries that can be connected to a power supply from a conventional outlet. In the embodiment shown in FIG. 1, the batteries are in a battery pack 56 that has a socket so that the batteries can be charged while the battery back 56 is in place in the chair. In another embodiment, the battery pack 56 is replaceable with a second battery pack that can be charged at a different location than the chair. Although a rechargeable battery 56 is illustrated, any suitable power source could be used in the alternative to provide power to the chair.

Figure 4:
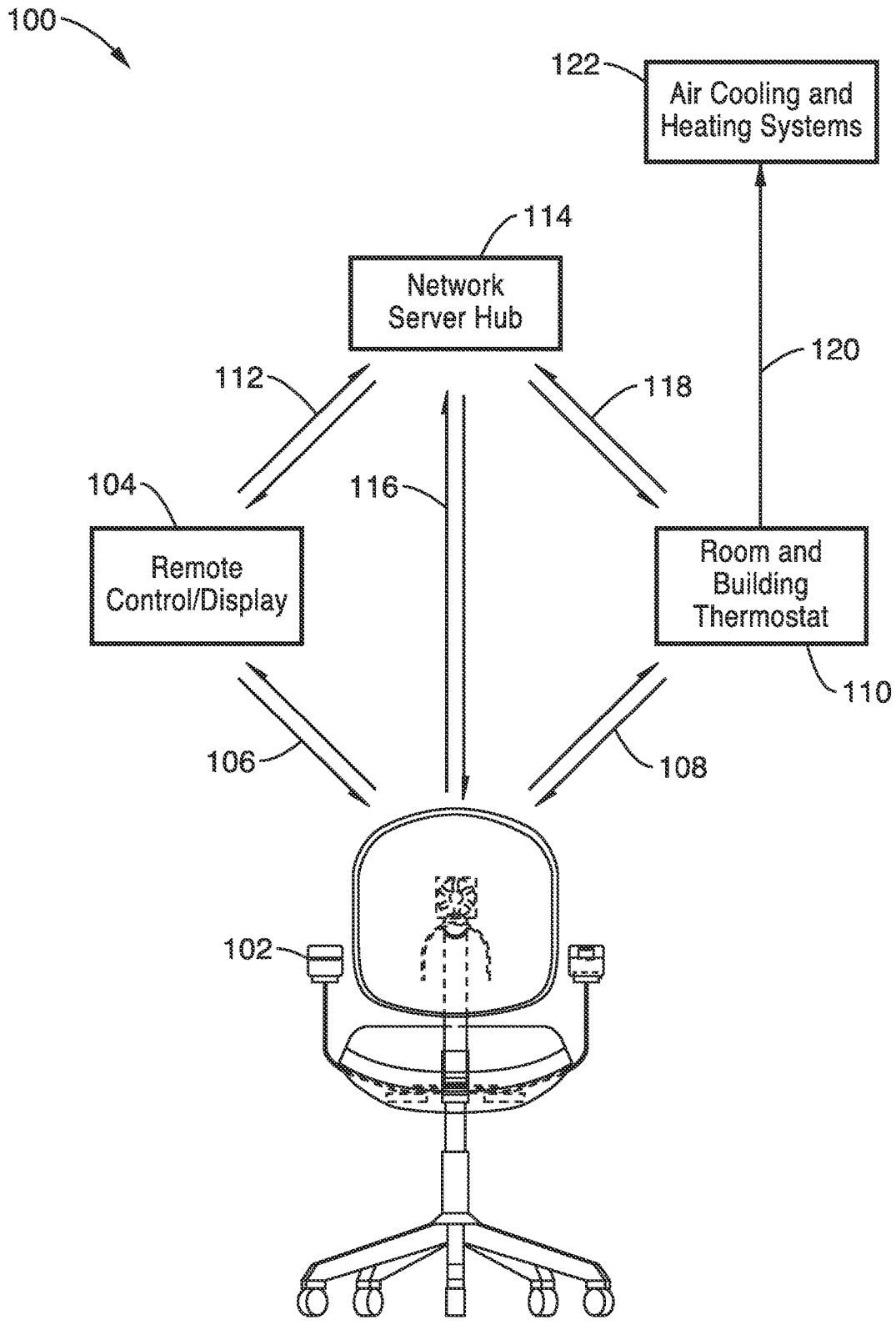
FIG. 4 is a schematic system diagram of chair controller integrated with a building environmental modification and control system according to one embodiment of the invention.

The control 54 of chair 10 may also be equipped with an apparatus with sensors that measure and collect information about chair occupancy, air temperature, and the occupant's choice of control settings. This information can be sent through cable or wireless communications to a server or other devices, and can be used to control the operation of third-party devices such as the building's central conditioning system as illustrated in FIG. 4.

In one embodiment, the chair 10 is fitted with one or more sensors 58 that can be monitored and influence the heating or cooling components of the chair. For example, sensors of temperature, relative humidity, occupancy, infrared radiation and optionally sensors of $CO_2$ or volatile organic compounds (VOCs) can be placed at a variety of locations on the chair to monitor the local environment surrounding the chair. In one embodiment, a pressure-activated microswitch is placed in the seat to shut off power when the chair is unoccupied.

The controller 54 can also have a communications subsystem that is configured to send and receive data from sensors, network computers and remote control devices such as smart telephones. In one embodiment, the controller 54 has a communications link that communicates with a remote control interface that displays the status of the sensors and allows remote activation of the fans and chair temperature controls. The communications capability of the control 54 also allows the chair 10 to become part of a network of chairs and devices that can control the local environment around each chair as well as the general interior environment of the building in a coordinated fashion. The complexity of the network can vary from a single chair and room to many chairs and many rooms or zones.

Dynamic control over the local environment surrounding a chair is possible with an integrated network. Control communications allow building environment management systems to receive command instructions as well as sensor information from individual chairs in addition to the normal thermostat inputs. The integration of such a system with building management systems allows the optimization of the building's heating, cooling and ventilating airflow based on occupancy, or heating and cooling based on occupant comfort. A network system makes possible automatic adjustments of settings based on the local environment, such as a heating setting which is only active when the environmental temperature is below a selected threshold.

One system configuration 100 with one chair 102 is schematically illustrated in FIG. 4. The chair 102 in this system configuration has a remote control with interface and display 104. The remote control 104 sends and receives commands and sensor data 106 wirelessly from the controller of the chair 102. Although a wireless control/interface 104 is preferred, a wired interface with a computer can also be used, for example.

The remote control/display interface 104 may have command programming for controlling the fan and heating/cooling functions of the chair 102 through the chair controller and can record user environmental preferences such as a preferred temperature ranges. The communication link 106 allows automatic synchronization of control between remote control interface 104 and the local control in chair 102.

In one embodiment, the controller of chair 102 is also in communication 108 with a room or building thermostat or environmental control system 110. Sensor data and on/off commands from chair 102 or remote control 104 can be communicated to the thermostat to initiate or override the thermostat settings and start or stop 120 the activity of the air cooling or heating machinery of the building.

In one simple network embodiment, the network is only composed of one or more chairs 102 in communication with a single room or building thermostat 110. The heating or cooling of the air in the room and the activation of the chair functions can be coordinated according to occupant comfort preferences and local environmental conditions. Network connected control of heating and cooling alongside local thermostat settings can be produced via the touchscreen of the remote 104 in one embodiment.

In the more complex network illustrated in FIG. 4, the chair 102 and the remote control/display 104 communicate with a network server 114. The remote 104 can send and receive command and data communications 112 to the network server 114. Preferences, locations, and specifications of chair 102 can be uploaded 112 to the network server 114 through the remote control/display 104. The chair 102 can also send and receive data and command communications 116 directly with the network server hub 114 so that the activity of the chair 102 can be specifically controlled by the server 114.

The network server 114 preferably has programming that directly or indirectly controls the building heating and cooling systems 122 and the individual chair system activity based on the local sensor data and preference commands from chairs that are in communication with the server 114. For example, the network server 114 could send command communications 118 to the building thermostat 110 to signal 120 the building air cooling or heating system 122 to activate or deactivate and provide temperature modified air to the location of a specific chair 102 for a specific duration or until the chair sensors indicate a preferred room temperature has been reached. At the same time, the programming of the server 114 can communicate commands 116 to chair 102 to activate fans or heating elements according to selected preferences until a selected chair temperature has been achieved.

The sensor data from each of the chairs 102 and from the thermostat or other environment management system 110 can be monitored or sampled periodically by the programming of server 114. In this embodiment, the server programming initiates the activity of the chair to heat or cool the chair when condition parameters are exceeded.

The various networked systems have the flexibility to provide dynamic control of chair temperatures, timing and control of both local and general environmental conditions. In addition to the level of control over conditions provided by the chair 102 and network control features, it is possible to regulate the total energy used by the whole environmental control system and still accommodate the comfort levels of the occupants of individual chairs.

Environmental conditions surrounding each chair and building location over time can be monitored and regulated over time. By providing local heating or cooling at the level of the chair rather than by simply conditioning the air of the building over time, the cost of providing a pleasant interior environment can be managed. Energy efficiency of the chair can also be optimized with the selection of low energy consumption components as well as the duration of usage events. For example, in one embodiment of the chair uses three low wattage fans (1.2 W each) and spot heating (14 Watt) and a pressure switch to turn off the chair when it is not occupied.

Limits to the temperature and duration of the heating or cooling elements and the range of air temperatures can also be optimized and imposed to reduce the overall energy usage of the system. For example, the environmental comfort conditions may be limited to the range of approximately 60° F. and approximately 80° F.

From the discussion above it will be appreciated that the invention can be embodied in various ways, including the following:

1. A heating and cooling system for a seat, comprising: (a) a seat body with at least one plenum, the plenum having one or more plenum openings; (b) a plurality of fans configured to create an airstream in the plenum; (c) a moisture-permeable material covering the plenum openings; (d) at least one heating source; and (e) a power supply for powering the heating source and the fans; wherein the airstream cools the moisture-permeable material of the seat body by convective and evaporative heat exchange.

2. The system as recited in any previous embodiment, further comprising a plenum backplane with infrared radiation reflective surfaces for directing heating and cooling to the user of the seat.

3. The system as recited in any previous embodiment, further comprising a plenum lined with thermal insulation.

4. The system as recited in any previous embodiment, wherein the heat source comprises a resistive heat strip.

5. The system as recited in any previous embodiment, wherein the power supply comprises rechargeable batteries.

6. The system as recited in any previous embodiment, further comprising a controller connected to the heating source, fans and power supply configured for controlling power levels to the heating source and fans.

7. The system as recited in any previous embodiment, further comprising a sensor selected from the group of sensors consisting of temperature, relative humidity, infrared, occupancy, $CO_2$ and volatile organic compounds (VOCs).

8. The system as recited in any previous embodiment, further comprising a delay circuit to reduce the amount of short-term cycling of heating/cooling power.

9. The system as recited in any previous embodiment, further comprising: a chair controller connected to the heating source, fans and power supply configured for controlling power levels to the heating source and fans; and a remote control operably coupled with the chair controller.

10. The system as recited in any previous embodiment, further comprising: a chair controller connected to the heating source, fans and power supply configured for controlling power levels to the heating source and fans; at least one building thermostat; and a remote control with a communications link operably coupled with the chair controller and thermostat; wherein the chair controller and thermostat functions are controlled by the remote control.

11. A building environmental control system, the system comprising: (a) a network computer server with programming and a communications link; (b) a plurality of thermostats operably connected to the server through the communications link; and (c) one or more seats, the seats comprising: (i) a seat body with at least one plenum, the plenum having one or more plenum openings; (ii) a plurality of fans configured to create an airstream in the plenum; (iii) a moisture-permeable material covering the plenum openings; (iv) at least one heating source; (v) a power supply for powering the heating source and the fans; (vi) a seat controller connected to the heating source, fans and power supply configured for controlling power levels to the heating source and fans, the seat controller operably connected to the server through the communications link; wherein server programming controls thermostat functions and seat controller functions; and wherein the plenum airstream cools the moisture-permeable material of the seat body by convective and evaporative heat exchange.

12. The system as recited in any previous embodiment, further comprising a remote control interface operably connected to the seat controller and operably connected to the server through the communications link.

13. The system as recited in any previous embodiment, wherein the seat further comprises at least one sensor connected to the seat controller and to the server through the communications link.

14. The system as recited in any previous embodiment, wherein the sensor is selected from the group of sensors consisting of temperature, relative humidity, occupancy, infrared radiation, $CO_2$ and volatile organic compounds (VOCs).

15. A personal comfort chair apparatus, comprising: (a) a seat body with at least one seat plenum, the seat plenum having one or more plenum openings; (b) a backrest body with at least one backrest plenum, the backrest plenum having one or more plenum openings; (c) a moisture-permeable material covering the seat plenum openings; (d) a moisture-permeable material covering the backrest plenum openings; (e) a plurality of fans configured to create an airstream in the seat plenum and the backrest plenum; and (f) a power supply powering the fans; wherein the fans provide an airstream across the side of the moisture-permeable material opposite the side of the material that is against the body of a user; and wherein the airstream cools the moisture-permeable material by convective and evaporative heat exchange.

16. The apparatus as recited in any previous embodiment, further comprising at least one heating source powered by the power supply.

17. The apparatus as recited in any previous embodiment, wherein the heat source comprises: a first resistive heat strip mounted to the moisture-permeable material of the seat body; and a second resistive heat strip mounted to the moisture-permeable material of the seat body.

18. The apparatus as recited in any previous embodiment, further comprising a plenum backplane with infrared radiation reflective surfaces for directing heating and cooling to the user of the chair.

19. The apparatus as recited in any previous embodiment, further comprising a plenum lined with thermal insulation.

20. The apparatus as recited in any previous embodiment, further comprising a controller connected to the heating source, fans and power supply configured for controlling power levels to the heating source and fans.

21. The apparatus as recited in any previous embodiment, the controller further comprising a delay circuit to reduce the amount of short-term cycling of heating/cooling power.

22. The apparatus as recited in any previous embodiment, further comprising an occupancy sensor that switches off power during periods when the chair is unoccupied.

23. The apparatus as recited in any previous embodiment, further comprising one or more sensors selected from the group of sensors consisting of temperature, relative humidity, occupancy, infrared, $CO_2$ and volatile organic compounds (VOCs).

24. The apparatus as recited in c any previous embodiment, further comprising: a chair controller connected to the heating source, fans and power supply configured for controlling power levels to the heating source and fans; and a remote control operably coupled with the chair controller.

25. The apparatus as recited in any previous embodiment, the remote control further comprising a display.

26. A personal comfort chair apparatus, comprising: (a) a seat body with at least one seat plenum, the seat plenum having one or more plenum openings; (b) a backrest body with at least one backrest plenum, the backrest plenum having one or more plenum openings; (c) a moisture-permeable material covering the seat plenum openings; (d) a moisture-permeable material covering the backrest plenum openings; (e) a plurality of fans configured to create an airstream in the seat plenum and the backrest plenum; (f) at least one heating source; (g) a power supply powering the heating source and fans; (h) a controller connected to the heating source, fans and power supply configured for controlling power levels to the heating source and fans; and (i) an occupancy sensor that switches off power during periods when the chair is unoccupied; wherein the fans provide an airstream across the side of the moisture-permeable material opposite the side of the material that is against the body of a user; and wherein the airstream cools the moisture-permeable material by convective and evaporative heat exchange.

27. The apparatus as recited in any previous embodiment, further comprising at least one sensor selected from the group of sensors consisting of temperature, relative humidity, occupancy, $CO_2$ and volatile organic compounds (VOCs).

28. The apparatus as recited in any previous embodiment, further comprising a thermally insulated plenum backplane with infrared radiation reflective surfaces for directing heating and cooling to the user of the chair.

29. The apparatus as recited in any previous embodiment, further comprising a remote control operably coupled with the controller.

30. The apparatus as recited in any previous embodiment, the remote control further comprising a display.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A heating and cooling system for seated room occupants, said system comprising:

(a) a seat body with at least one plenum, said plenum having one or more plenum openings;

(b) a plurality of fans configured to create an airstream in said plenum;

(c) a moisture-permeable material covering said plenum openings;

(d) a power supply for powering said fans;

(e) a seat controller connected to the fans and power supply configured for controlling power levels to the fans;

(f) at least one building room thermostat; and (g) a remote control with a communications link operably coupled with the seat controller and thermostat;

(h) wherein seat controller and thermostat functions are controlled by the remote control; and (i) wherein said plenum airstream cools said moisture-permeable material of said seat body by convective and evaporative heat exchange.

2. The system as recited in claim 1, said seat body further comprising at least one heating source disposed within said plenum powered by said power supply and controlled by said seat controller.

3. The system as recited in claim 2, wherein said heat source comprises a resistive heat strip.

4. The system as recited in claim 1, wherein said power supply comprises rechargeable batteries.

5. The system as recited in claim 1, further comprising at least one sensor selected from the group of sensors consisting of temperature, relative humidity, infrared, occupancy, $CO_2$ and volatile organic compounds (VOCs).

6. The system as recited in claim 1, wherein said seat body comprises:

a seat base with at least one seat plenum, said seat plenum having one or more plenum openings;

a backrest body with at least one backrest plenum, said backrest plenum having one or more plenum openings;

a moisture-permeable material covering said seat plenum openings;

a moisture-permeable material covering said backrest plenum openings; and a plurality of fans configured to create an airstream in said seat plenum and said backrest plenum across the side of the moisture-permeable material opposite the side of the material that is against the body of a user;

wherein the airstream cools the moisture-permeable material by convective and evaporative heat exchange.

7. The system as recited in claim 6, further comprising at least one resistive heat strip disposed in said seat plenum and in said backrest plenum.

8. The apparatus as recited in claim 6, each plenum further comprising a liner of thermal insulation.

9. The system as recited in claim 1, said remote control further comprising:

a display; and a computer processor; and a non-transitory computer-readable memory storing instructions executable by the computer processor;

wherein said instructions, when executed by the computer processor, perform steps comprising:

(i) monitoring ambient room and seat temperatures;

(ii) controlling the room thermostat; and (iii) controlling the seat controller.

* * * * *